US009903570B2

(12) United States Patent
Snowden

(10) Patent No.: US 9,903,570 B2
(45) Date of Patent: Feb. 27, 2018

(54) DECORATIVE PANELING ASSEMBLY

(71) Applicant: Kristin Snowden, Anaheim, CA (US)

(72) Inventor: Kristin Snowden, Anaheim, CA (US)

( * ) Notice: Subject to any disclaimer, the term of this patent is extended or adjusted under 35 U.S.C. 154(b) by 0 days.

(21) Appl. No.: 15/217,257

(22) Filed: Jul. 22, 2016

(65) Prior Publication Data

US 2018/0023787 A1 Jan. 25, 2018

(51) Int. Cl.

| | |
|---|---|
| ***F21V 21/08*** | (2006.01) |
| ***F21V 23/00*** | (2015.01) |
| ***F21V 21/34*** | (2006.01) |
| *F21Y 115/10* | (2016.01) |
| *F21W 121/00* | (2006.01) |

(52) U.S. Cl.

CPC ..... *F21V 21/08* (2013.01); *F21V 21/34* (2013.01); *F21V 23/001* (2013.01); *F21W 2121/00* (2013.01); *F21W 2121/004* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 5,943,803 | A | 8/1999 | Zinbarg | |
| D425,820 | S | 5/2000 | Coleman | |
| 6,572,238 | B1 | 6/2003 | Johnson | |
| 8,336,264 | B2 | 12/2012 | Sato et al. | |
| 8,806,826 | B2 | 8/2014 | Mann | |
| 9,267,295 | B2 * | 2/2016 | Mann | E04C 2/38 |
| 2007/0009706 | A1 | 1/2007 | Beck | |
| 2007/0062136 | A1 | 3/2007 | Kim et al. | |
| 2010/0135022 | A1 * | 6/2010 | Deguara | H01R 13/73 362/249.06 |

FOREIGN PATENT DOCUMENTS

| | | |
|---|---|---|
| WO | WO03006771 | 1/2003 |

* cited by examiner

*Primary Examiner* — Kristy A Haupt

(57) ABSTRACT

A decorative paneling assembly for interior and exterior decorative display includes a plurality of panels that is interlocking. Each panel comprises a plate that is substantially flat. A plurality of first couplers and a plurality of second couplers are coupled to opposing side edges of the plate. A plurality of fasteners is coupled to the plate and is configured to reversibly couple the plate to a surface. An image is coupled to and positioned on a front of the plate. A power cord is coupled to the plate and is configured to interconnect with the power cords of adjacent panels. A plurality of lights is coupled to the plate and is operationally coupled to the power cord. The second couplers are positioned to couple with the first couplers to interlock adjacent panels. The lights are positioned to illuminate the images for decorative display.

15 Claims, 4 Drawing Sheets

DECORATIVE PANELING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to paneling assemblies and more particularly pertains to a new paneling assembly for interior and exterior decorative display.

BRIEF SUMMARY OF THE INVENTION

An embodiment of the disclosure meets the needs presented above by generally comprising a plurality of panels that is interlocking. Each panel comprises a plate that is substantially flat. A plurality of first couplers and a plurality of second couplers are coupled to opposing side edges of the plate. A plurality of fasteners is coupled to the plate and is configured to reversibly couple the plate to a surface. An image is coupled to and positioned on a front of the plate. A power cord is coupled to the plate and is configured to interconnect with the power cords of adjacent panels. A plurality of lights is coupled to the plate and is operationally coupled to the power cord. The second couplers are positioned to couple with the first couplers to interlock adjacent panels. The lights are positioned to illuminate the images for decorative display.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
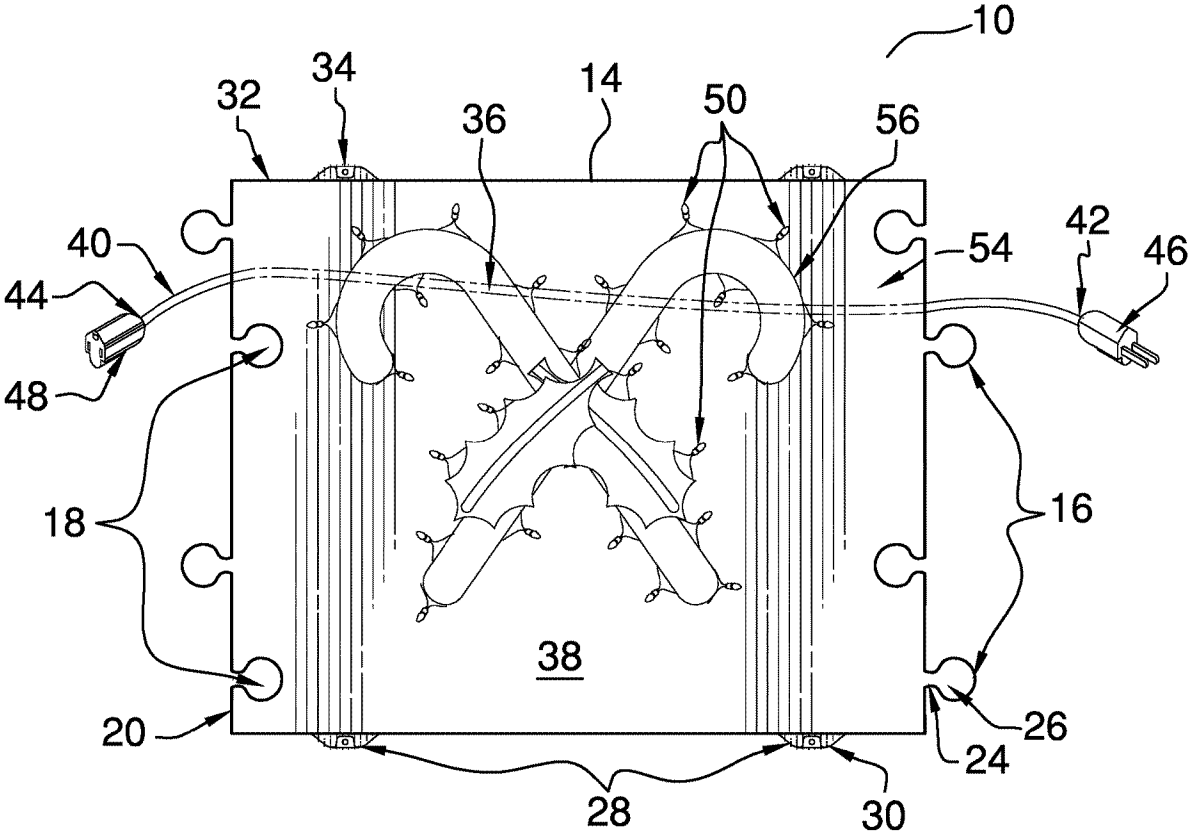
FIG. 1 is a front view of a decorative paneling assembly according to an embodiment of the disclosure.
Figure 2:
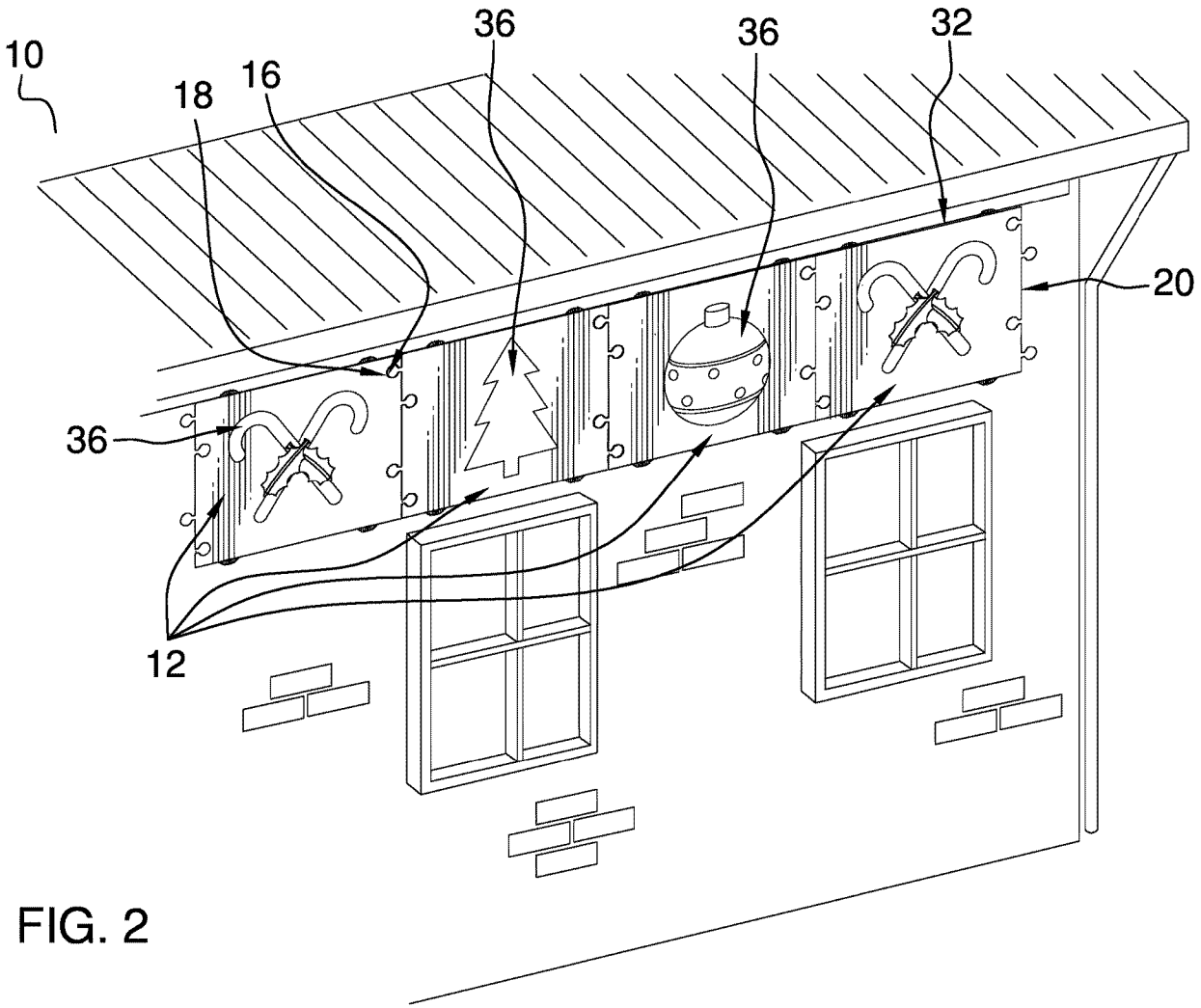
FIG. 2 is an in-use view of an embodiment of the disclosure.
Figure 3:
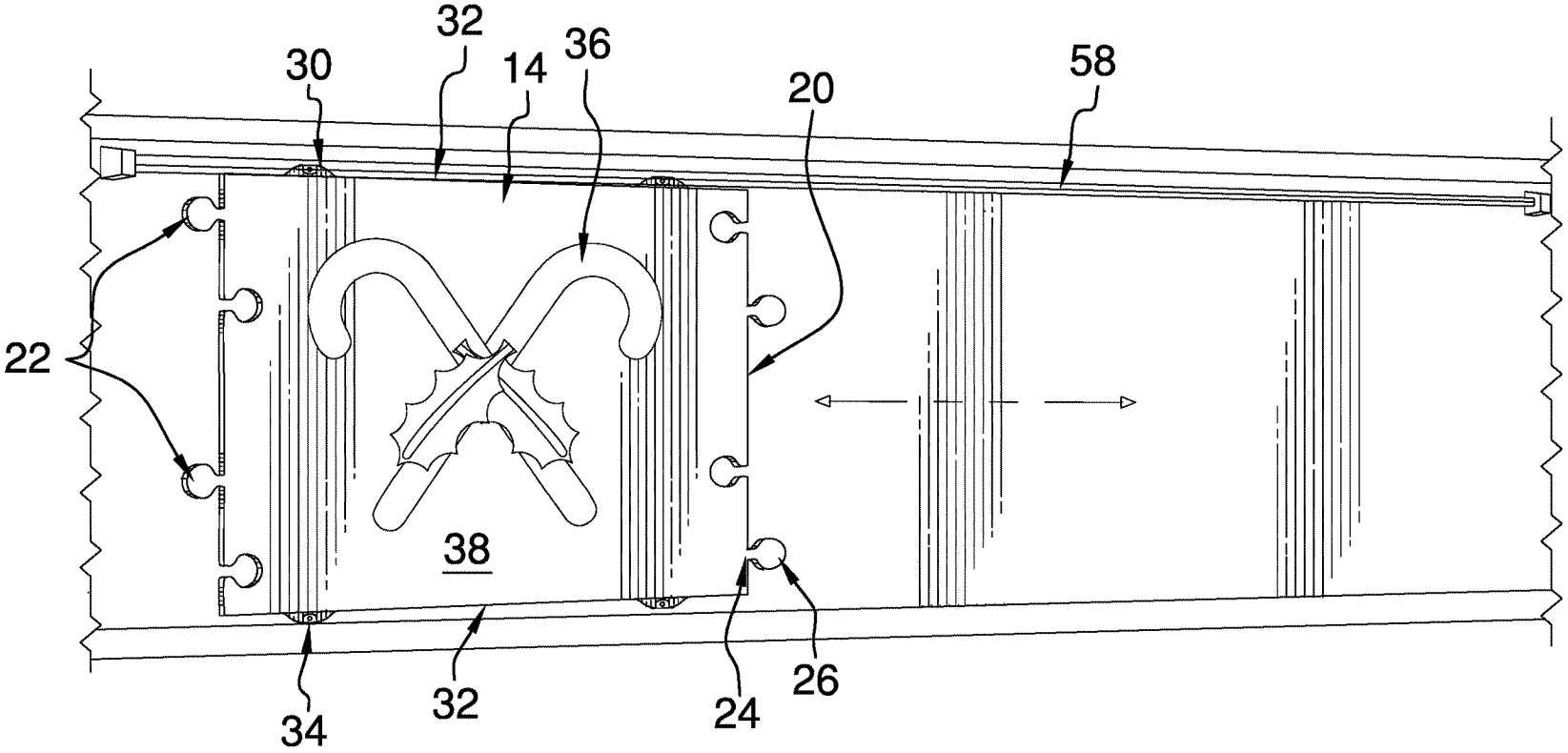
FIG. 3 is an in-use view of an embodiment of the disclosure.
Figure 4:
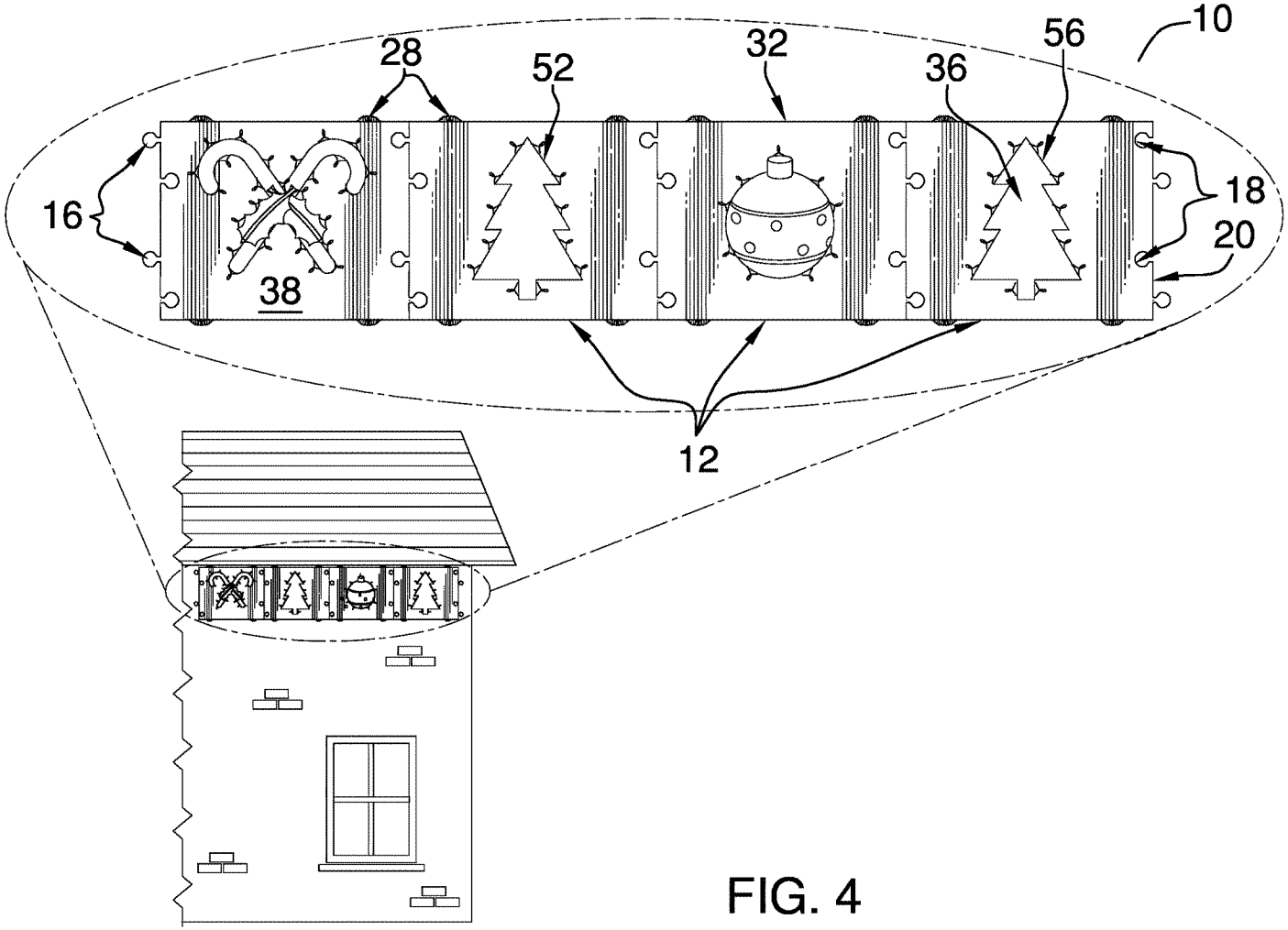
FIG. 4 is a detail view of an embodiment of the disclosure.

With reference now to the drawings, and in particular to FIGS. 1 through 4 thereof, a new paneling assembly embodying the principles and concepts of an embodiment of the disclosure and generally designated by the reference numeral 10 will be described.

As best illustrated in FIGS. 1 through 4, the decorative paneling assembly 10 generally comprises a plurality of panels 12. The panels 12 are interlocking. Each panel 12 comprises a plate 14 that is substantially flat. In one embodiment, the plate 14 is substantially rectangularly shaped. In another embodiment, the plate 14 comprises plastic. In yet another embodiment, the plate 14 is substantially transparent.

A plurality of first couplers 16 and a plurality of second couplers 18 are coupled to opposing side edges 20 of the plate 14. The second couplers 18 are complementary to the first couplers 16. The second couplers 18 are positioned on the plate 14 such that the second couplers 18 are positioned to couple with the first couplers 16 to interlock adjacent panels 12.

In one embodiment, the first couplers 16 comprise first tabs 22. Each first tab 22 comprises a stem 24 that is coupled to and extends coplanarly from a respective opposing side edge 20. A head 26 is coupled to and extends coplanarly from the stem 24 distal from the respective opposing side edge 20. In another embodiment, the head 26 is substantially circularly shaped. In yet another embodiment, the plurality of first couplers 16 comprises two first couplers 16 positioned on each of the opposing side edges 20.

A plurality of fasteners 28 is coupled to the plate 14. The fasteners 28 are configured to reversibly couple the plate 14 to a surface. Each fastener 28 comprises a second tab 30 that is coupled to and extends coplanarly from a respective opposing horizontal edge 32 of the plate 14. In one embodiment, the second tab 30 comprises metal. A hole 34 is positioned through the second tab 30. The hole 34 is positioned in the second tab 30 such that the hole 34 is configured to receive mounting hardware to couple the plate 14 to the surface. In another embodiment, the plurality of fasteners 28 comprises two fasteners 28 positioned on each of the opposing horizontal edges 32.

An image 36 is coupled to and positioned on a front 38 of the plate 14.

A power cord 40 is coupled to the plate 14. The power cord 40 is configured to interconnect with the power cords 40 of adjacent panels 12. The power cord 40 has a first end 42 and a second end 44. In one embodiment, the first end 42 comprises a male connector 46 and the second end 44 comprises a female connector 48.

A plurality of lights 50 is coupled to the plate 14 and is operationally coupled to the power cord 40. The lights 50 are configured to illuminate the image 36. In one embodiment, the lights 50 comprise light emitting diodes 52. In another embodiment, the lights 50 are programmable such that the lights 50 are configurable for constant illumination, random blinking and sequential blinking. In yet another embodiment, the lights 50 are coupled to a back 54 of the plate 14. In still yet another embodiment, the lights 50 are coupled to the plate 14 proximate to a border 56 of the image 36.

In one embodiment, the assembly 10 comprises a track 58 that is configured to couple to the surface. The track 58 is configured to slidably couple to the panels 12. The track 58 is positioned on the surface such that the track 58 is positioned to slidably couple to the panels 12.

In use, the second couplers 18 are positioned on the plate 14 and are positioned to couple with the first couplers 16 to interlock adjacent panels 12. The power cord 40 is configured to interconnect with the power cords 40 positioned on adjacent panels 12. The lights 50 are positioned to illuminate the images 36 for decorative display.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A decorative paneling assembly comprising a plurality of panels, said panels being interlocking, each said panel comprising:

a plate, said plate having continuous flat and parallel surfaces defining a front and a back of said plate such that said plate is unperforated within a peripheral edge of said plate, said plate being translucent;

a plurality of first couplers coupled to opposing side edges of said plate;

a plurality of second couplers coupled to said opposing side edges of said plate, said second couplers being complementary to said first couplers;

a plurality of fasteners coupled to said plate, said fasteners being configured to removably couple said plate to a surface;

an image coupled to and positioned on said front of said plate;

a power cord coupled to said plate, said power cord being configured for interconnection to said power cords of adjacent said panels;

a plurality of lights coupled to said plate and operationally coupled to said power cord, said lights being coupled to a back of said plate wherein said lights are positioned to be illuminated to shine through said panel to illuminate said image; and wherein said second couplers are positioned on said plate such that said second couplers are positioned to couple with said first couplers to interlock said adjacent said panels, such that said lights are positioned to illuminate said images for decorative display.

2. The assembly of claim 1, further including said plate being substantially rectangularly shaped.

3. The assembly of claim 1, further including said plate comprising plastic.

4. The assembly of claim 1, further including said first couplers comprising first tabs, each said first tab comprising:

a stem coupled to and extending coplanarly from a respective said opposing side edge; and a head coupled to and extending coplanarly from said stem distal from said respective said opposing side edge.

5. The assembly of claim 4, further including said head being substantially circularly shaped.

6. The assembly of claim 1, further including said plurality of first couplers comprising two said first couplers positioned on each of said opposing side edges of said plate.

7. The assembly of claim 4, further including each said fastener comprising:

a second tab coupled to and extending coplanarly from a respective opposing horizontal edge of said plate;

a hole positioned through said second tab; and wherein said hole is positioned in said second tab such that said hole is configured to receive mounting hardware to couple said plate to the surface.

8. The assembly of claim 7, further including said second tab comprising metal.

9. The assembly of claim 1, further including said plurality of fasteners comprising two said fasteners positioned on each of opposing horizontal edges of said plate.

10. The assembly of claim 1, further including said power cord having a first end and a second end, said first end comprising a male connector, said second end comprising a female connector.

11. The assembly of claim 1, further including said lights comprising light emitting diodes.

12. The assembly of claim 1, further including said lights being programmable such that said lights are configurable for constant illumination, random blinking and sequential blinking.

13. The assembly of claim 1, further including said lights being coupled to said plate proximate to a border of said image.

14. The assembly of claim 1, further including a track configured for coupling to the surface, said track being configured for slidably coupling to said panels, wherein said track is positioned on the surface such that said track is positioned to slidably couple to said panels.

15. A decorative paneling assembly comprising a plurality of panels, said panels being interlocking, each said panel comprising:

a plate, said plate being substantially flat having continuous flat and parallel surfaces defining a front and a back of said plate such that said plate is unperforated within a peripheral edge of said plate, said plate being substantially rectangularly shaped, said plate comprising plastic, said plate being translucent;

a plurality of first couplers coupled to opposing side edges of said plate;

a plurality of second couplers coupled to said opposing side edges of said plate, said second couplers being complementary to said first couplers, wherein said second couplers are positioned on said plate such that said second couplers are positioned to couple with said first couplers to interlock adjacent said panels;

said first couplers comprising first tabs, each said first tab comprising:

a stem coupled to and extending coplanarly from a respective said opposing side edge, and a head coupled to and extending coplanarly from said stem distal from said respective said opposing side edge, said head being substantially circularly shaped;

said plurality of first couplers comprising two said first couplers positioned on each of said opposing side edges;

a plurality of fasteners coupled to said plate, said fasteners being configured to reversibly couple said plate to a surface, each said fastener comprising:

a second tab coupled to and extending coplanarly from a respective opposing horizontal edge of said plate, said second tab comprising metal, a hole positioned through said second tab, and wherein said hole is positioned in said second tab such that said hole is configured to receive mounting hardware to couple said plate to the surface;

said plurality of fasteners comprising two said fasteners positioned on each of said opposing horizontal edges;

an image coupled to and positioned on said front of said plate;

a power cord coupled to said plate, said power cord being configured for interconnection to said power cords of said adjacent said panels, said power cord having a first end and a second end, said first end comprising a male connector, said second end comprising a female connector;

a plurality of lights coupled to said plate and operationally coupled to said power cord, said lights comprising light emitting diodes, said lights being programmable such that said lights are configurable for constant illumination, random blinking and sequential blinking, said lights being coupled to a back of said plate wherein said lights are positioned to be illuminated to shine through said panel to illuminate said image, said lights being coupled to said plate proximate to a border of said image;

a track configured for coupling to the surface, said track being configured for slidably coupling to said panels, wherein said track is positioned on the surface such that said track is positioned to slidably couple to said panels; and wherein said second couplers are positioned on said plate such that said second couplers are positioned to couple with said first couplers to interlock said adjacent said panels, wherein said power cord is configured to interconnect with said power cords positioned on said adjacent said panels, such that said lights are positioned to illuminate said images for decorative display.

* * * * *